US006065971A

United States Patent [19]

Lennon

[11] Patent Number: 6,065,971

[45] Date of Patent: May 23, 2000

[54] FINGER RING COUNTING DEVICE

[76] Inventor: Ralph E. Lennon, 625 River Ave., Providence, R.I. 02908

[21] Appl. No.: 09/378,113

[22] Filed: Aug. 20, 1999

[51] Int. Cl.[7] ..... A44C 23/00

[52] U.S. Cl. ..... 434/246; 434/188; 434/208; 63/3; 63/15

[58] Field of Search ..... 63/3, 15, 15.7; 434/167, 172, 188, 191, 192, 193, 203, 205, 208, 246, 386, 402

[56] References Cited

U.S. PATENT DOCUMENTS

| | | | |
|---|---|---|---|
| D. 68,993 | 12/1925 | Sager . | |
| D. 104,139 | 4/1937 | Gruen . | |
| D. 104,742 | 6/1937 | Gruen . | |
| D. 104,849 | 6/1937 | Gruen . | |
| D. 135,116 | 2/1943 | Broas . | |
| D. 164,777 | 10/1951 | Kelly . | |
| D. 166,107 | 3/1952 | Towle . | |
| D. 171,562 | 2/1954 | Towle . | |
| D. 217,095 | 4/1970 | Taylor . | |
| 811,195 | 1/1906 | Beck . | |
| 899,482 | 9/1908 | Crawlet . | |
| 921,759 | 5/1909 | Walker | 63/3 |
| 950,546 | 3/1910 | Veeder . | |
| 1,234,204 | 7/1917 | O'Brien . | |
| 1,271,992 | 7/1918 | Baldwin . | |
| 1,324,524 | 12/1919 | Silver | 434/246 |
| 1,505,366 | 8/1924 | Barr . | |
| 1,579,820 | 4/1926 | Kislinger . | |
| 1,931,493 | 10/1933 | Herz . | |
| 1,938,727 | 12/1933 | Tammany . | |
| 2,187,664 | 1/1940 | Rogus . | |
| 2,351,918 | 6/1944 | Brennan . | |
| 2,376,266 | 5/1945 | Moore . | |
| 2,461,130 | 2/1949 | Szaj . | |
| 2,653,402 | 9/1953 | Bonagura | 63/3 |
| 2,666,581 | 1/1954 | Smith . | |
| 2,717,737 | 9/1955 | Hoelscher . | |
| 2,730,816 | 1/1956 | Garrett . | |
| 2,937,459 | 5/1960 | Belfield . | |
| 2,956,349 | 10/1960 | Hoban . | |
| 2,972,819 | 2/1961 | Graham . | |
| 2,998,188 | 8/1961 | Mast et al. . | |
| 3,325,915 | 6/1967 | Duggan . | |
| 3,374,949 | 3/1968 | Hayden . | |
| 4,977,757 | 12/1990 | Mesica et al. | 63/15 |

*Primary Examiner*—Sam Rimell

*Attorney, Agent, or Firm*—Barlow, Josephs & Holmes, Ltd.

[57] ABSTRACT

A finger ring counting device enables persons to accurately count prayers while saying the Rosary. The counting device is embodied in a ring structure which can be inconspicuously worn on the hand, and on which there are a number of beads which are manually movable around the circumference of the ring for counting. The device includes a finger ring having a continuous outwardly facing surface and a continuous circumferential channel formed in the outwardly facing surface. Eleven spherical beads are slidably captured within the channel where they are slidably movable around the outside of the ring. The counting device further includes a gate structure including a body portion having a bottom wall which straddles the channel and a top wall constructed and arranged for receiving an ornamental element thereon. The bottom wall cooperates with the aid channel to form a passage through which the beads slidably pass. The gate structure further includes a resilient spring arm mounted on the bottom wall of the body portion that extends downwardly from the bottom wall into the channel to selectively restrict passage of the beads from an entrance side of the gate structure to an exit side. In use, the operator manually urges one bead at a time from the entrance side past the resilient spring arm to the exit side.

16 Claims, 4 Drawing Sheets

FINGER RING COUNTING DEVICE

BACKGROUND AND SUMMARY OF THE INVENTION

The instant invention relates to counting devices which enable persons to accurately count prayers, such as while saying the Rosary, and more particularly to a counting device embodied in a ring structure which can be inconspicuously worn on the hand, and on which there are a number of beads which are manually movable around the circumference of the ring for counting.

Many people of the Catholic faith make a daily habit of saying a set of prayers known as the "Rosary". The Rosary consists of a set of prayers which are repeated in a set fashion. Typically, the Rosary is said with the aid of a set of beads known as Rosary beads, consisting of different sets of beads affixed to a string. The Rosary bead strings are usually held in the persons hand, and prayers are counted by passing the persons fingers along the set of beads counting the beads as the prayers are said. A complete course around the set of beads completes the set of prayers. With an ever more busy world, people of the Catholic faith cannot find quiet personal time to pray, and often turn to saying the Rosary in public places, such as while they commute to work on a bus, train, plane etc. In this regard, a set of Rosary beads is quite noticeable to those around, and more often than not, these people do not want to draw undesired attention from onlookers. Accordingly, the use of alternative counting devices to say the Rosary has become popular. In this regard, a variety of different counting devices, including modified rings, bracelets, hand held clickers, watch wrist bands, etc have been developed to allow such persons to quietly and inconspicuously say the Rosary without drawing unwanted attention.

The instant invention provides a finger ring counting device that enables persons to accurately count prayers while saying the decades of the Rosary. The counting device is embodied in a ring structure which can be inconspicuously worn on the hand, and on which there are a number of beads which are manually movable around the circumference of the ring for counting. The device includes a finger ring having a continuous outwardly facing surface and a continuous circumferential channel formed in the outwardly facing surface. Eleven spherical beads are slidably captured within the channel where they are slidably movable around the outside of the ring. One of the beads includes an indicia indicating that bead as a starting bead for the repeating decades of the Rosary. The counting device further includes a gate structure including a body portion having a bottom wall which straddles the channel and a top wall constructed and arranged for receiving an ornamental insert therein. The bottom wall cooperates with the channel to form a passage through which the beads slidably pass. The gate structure further includes a resilient spring arm mounted on the bottom wall of the body portion that extends downwardly from the bottom wall into the channel to selectively restrict passage of the beads from an entrance side of the gate structure to an exit side. In use, the operator manually urges one bead at a time from the entrance side past the resilient spring arm to the exit side. Movement of a bead from the entrance side to the exit side represents a count of one. When the wearer completes a decade of ten prayers, the starting bead is returned to the starting position to begin another decade.

Accordingly, among the objects of the instant invention are: the provision of a counting device for counting prayers while saying the Rosary; the provision of a modified ring device including a plurality of beads which are manually movable in a channel around the circumference of the ring; the provision of such a modified ring further including a resilient gate device under which the beads are passed for counting; and the provision of such a modified ring which can be inconspicuously operated by user without drawing unwanted attention.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
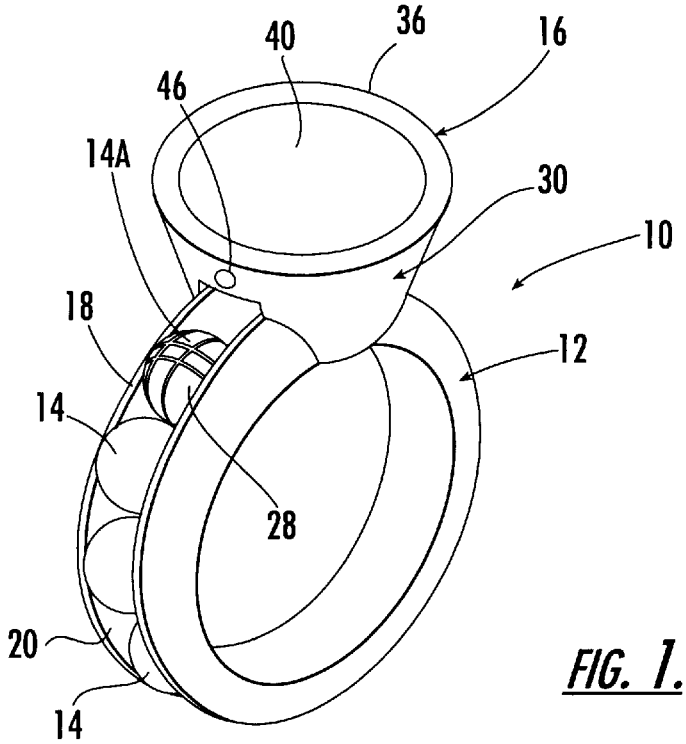
FIG. 1 is a perspective view of the rosary counter ring according to the present invention.
Figure 2:
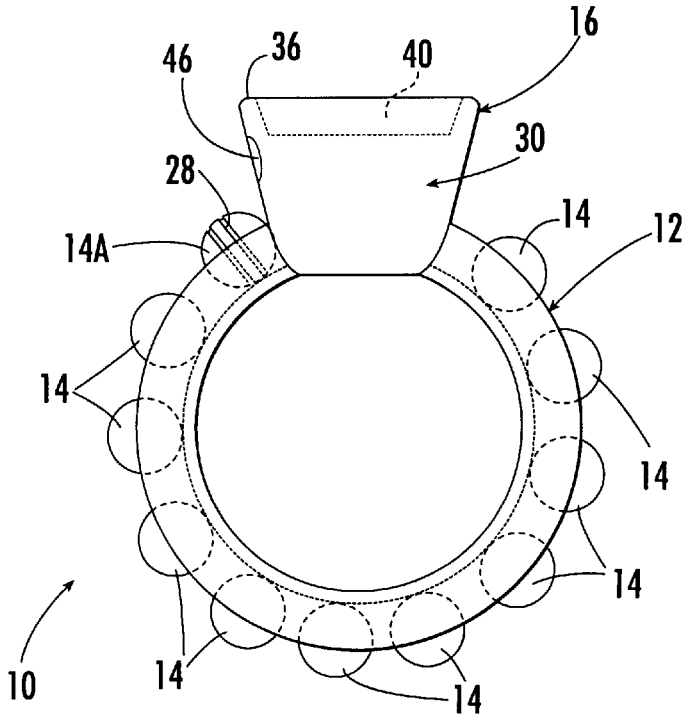
FIG. 2 is side view thereof.
Figure 3:
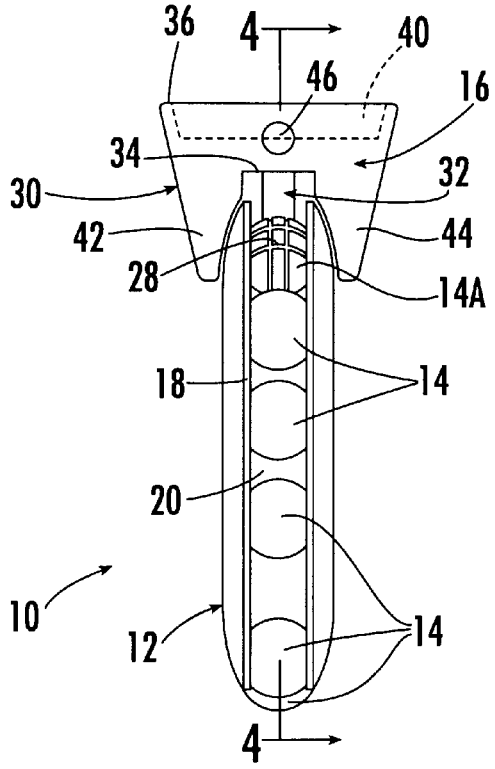
FIG. 3 an end view thereof.
Figure 4:
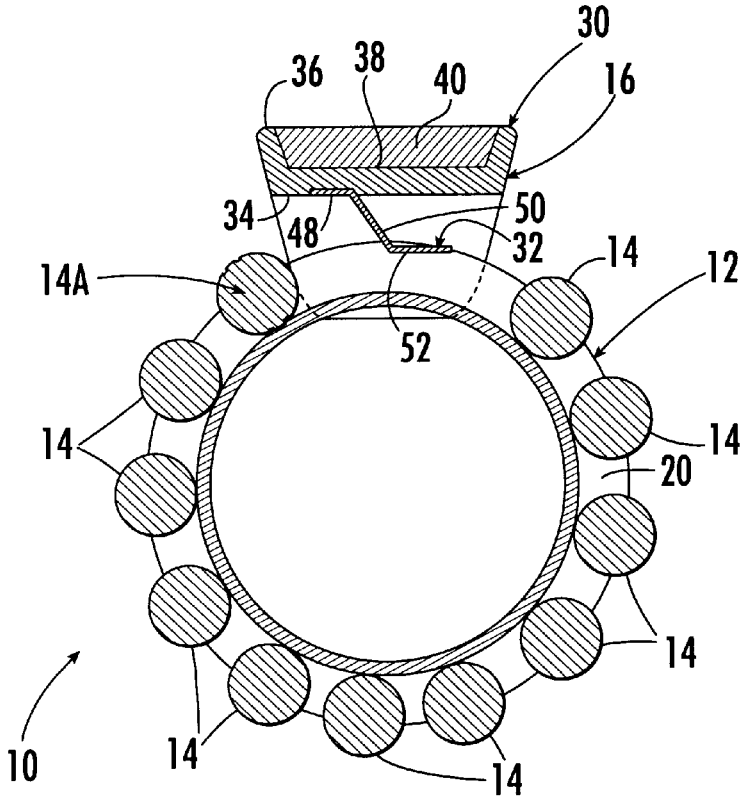
FIG. 4 is a cross-sectional view thereof taken along line 4—4 of FIG. 3.

Referring now to the drawings, the finger ring counting device of the instant invention is illustrated and generally indicated at 10 in FIGS. 1–8. As will hereinafter be more fully described, the finger ring counting device 10 enables persons to accurately count prayers while saying the Rosary. The counting device is embodied in a ring structure which can be inconspicuously worn on the hand, and on which there are a number of beads which are manually movable around the circumference of the ring for counting.

More specifically, finger ring counting device 10 includes a finger ring generally indicated at 12, a plurality of spherical beads generally indicated 14, and a gate assembly generally indicated at 16.

The finger ring 12 includes a continuous outwardly facing surface 18 and a continuous circumferential channel 20 formed in the outwardly facing surface 18. The channel is preferably formed as a substantially rectangular channel with a bottom wall 22 and opposing side walls 24, 26. As can be seen from FIG. 8, the sides walls 24, 26 converge inwardly from the bottom wall 22 to slidably capture the beads 14 within the channel 20. The ring 12 is preferably formed from a metal material, either precious or non-precious metal, and can be fabricated according to any well known metal forming process.

The spherical beads 14 are also preferably formed from metal and have a diameter which is slightly less than the height of the side walls 24,26 of the channel 20 (see FIG. 8) to thereby enable the beads 14 to slidably move within the channel 20 with only minimal friction restriction. One of the beads 14A includes an indicia indicating that bead as a starting bead for the repeating decades of the Rosary. In the illustrated embodiment, the starting bead 14A is provided with a plurality of grooves 28 in the outer surface thereof. These grooves 28 enable the user to feel and identify the starting bead 14A with actually looking at the device 10. Alternatively, the starting bead 14A could be painted with an indicia or could be made of a different metal, or event further still painted a different color.

The counting device 10 further includes gate assembly 16 comprising a body portion generally indicated at 30 and a resilient spring arm generally indicated at 32. The body portion 30 is generally frusto-conical in shape having a bottom wall 34 which straddles the channel 20 and a top wall 36 constructed and arranged for receiving an ornamental element thereon. The top wall 36 is preferably formed with a recess 38 for receiving an ornamental insert 40 therein, or alternatively a stone setting (not shown). However, it is to be understood that the body portion 30 could alternatively be formed in other shapes so long as it includes a bottom wall which straddles the channel. The bottom wall 34 of the body portion 30 cooperates with the channel 20 to form a passage through which the beads 14 slidably pass. In this regard, the bottom wall 34 of the body portion 30 is formed as part of a longitudinal slot having sides 42, 44 which wrap around the side walls 24, 26 of the finger ring 12 (See FIG. 3). This slotted arrangement allows a larger surface area for soldering of the body portion 30 to the finger ring 12, is further provided for a more pleasing aesthetic appearance. The resilient spring arm 32 is mounted on the bottom wall 34 of the body portion 30 and extends downwardly from the bottom wall 34 into the channel 20 to selectively restrict passage of the beads 14 from an entrance side of the gate assembly 16 to an exit side. In this regard, the entrance side of the gate assembly 16 is provided with an indicia 46 to indicate the entrance side and the direction in which the beads 14 pass through the gate 16. The resilient spring arm 32 includes a base portion 48 which is soldered, or otherwise anchored to the bottom wall 34 of the body portion 30, a first portion 50 which extends downwardly, and a second portion 52 extending at an angle to the first portion 50 longitudinally in the direction of the channel 20 from the entrance side to the exit side so as to allow passage of the beads 14 in one direction (See Fig, 4).

Figure 5:
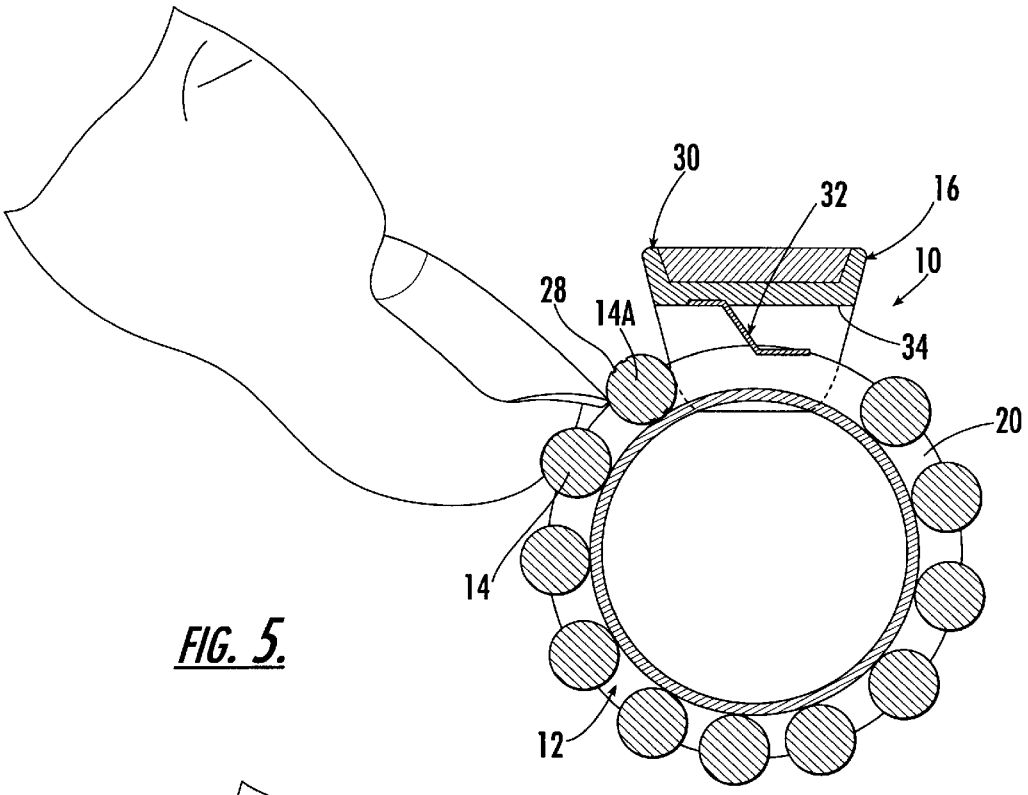
FIG. 5 is another cross-sectional view thereof showing a starting position of a bead prior to movement through the counting gate.
Figure 6:
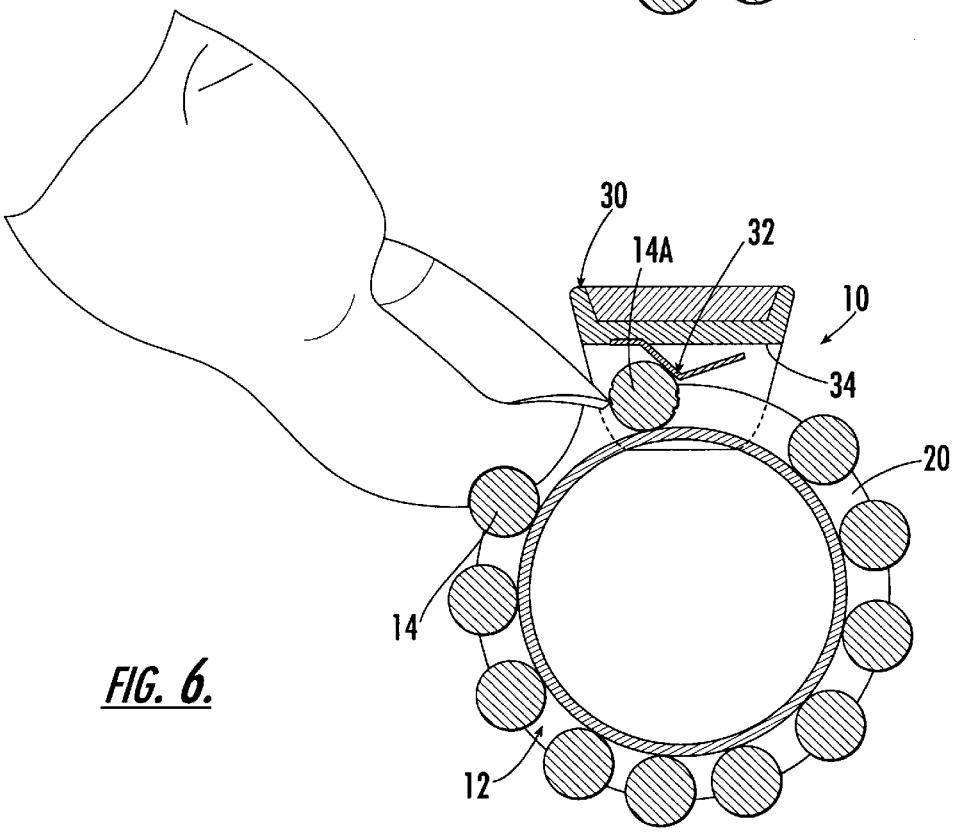
FIG. 6 is yet another cross-sectional view thereof showing the bead moving through the counting gate.
Figure 7:
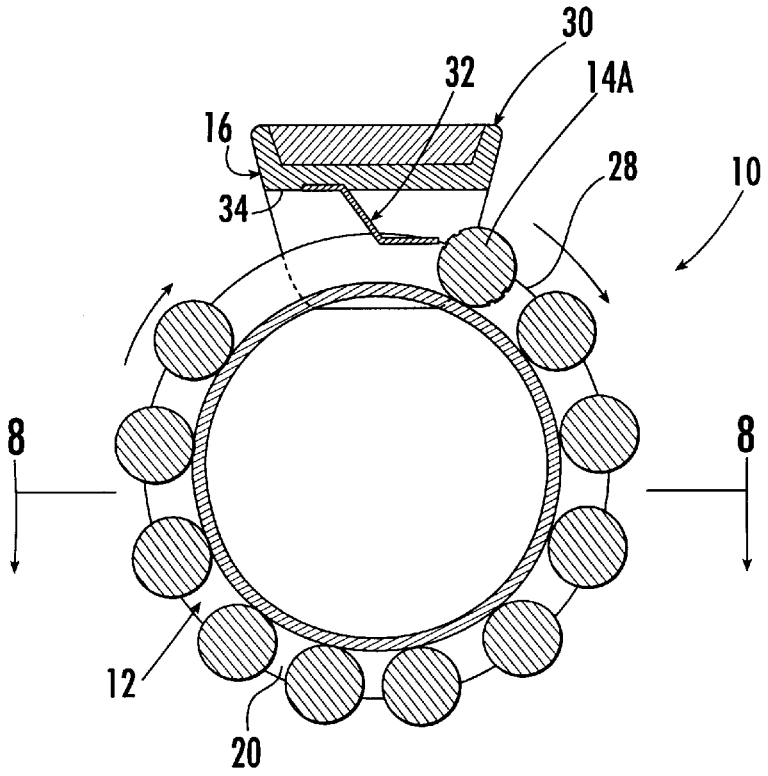
FIG. 7 is still another cross-sectional view thereof showing the bead passed completely through the counting gate.
Figure 8:
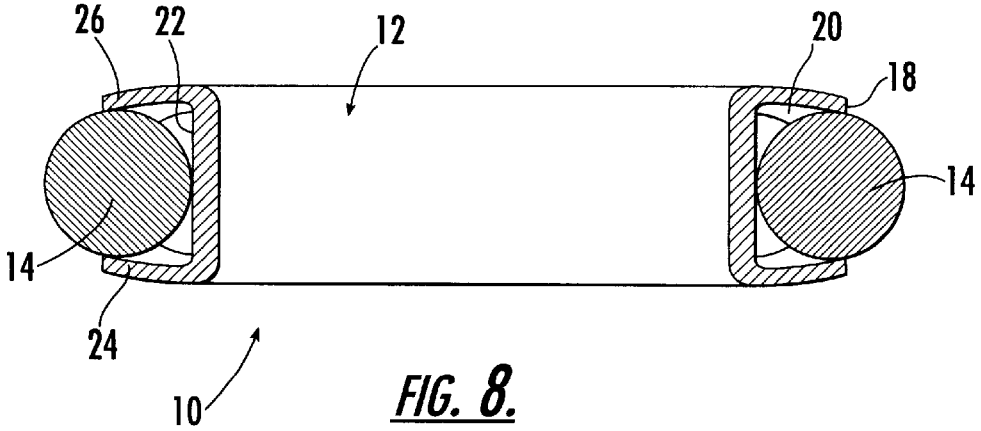
FIG. 8 is yet still another cross-sectional view thereof taken along line 8—8 of FIG. 7.

Turning now to FIGS. 5–7, in use, the operator manually urges, such as by the use of a thumb, or other finger, one bead at a time from the entrance side (FIG. 5) past the resilient spring arm 32 (FIG. 6) to the exit side (FIG. 7). Movement of a bead 14 from the entrance side to the exit side represents a count of one. When the wearer completes a decade of ten prayers, the starting bead 14A is returned to the starting position (FIG. 5) to begin another decade.

Although the respective elements of the present counting device 10 have been indicated as being fabricated from metal, it is to be understood that the entire device, including the ring 12, beads 14, and gate assembly 16 could easily be molded from plastic, or formed from any other suitable material.

It can therefore be seen that the instant invention provides a unique and novel counting device for counting prayers while saying the Rosary. The provision of a modified ring device including a plurality of beads which are manually movable in a channel around the circumference of the ring effectively enables a person to discretely count prayers without drawing unwanted attention. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A finger ring counting device comprising:

a finger ring having a continuous outwardly facing surface and a continuous circumferential channel formed in said outwardly facing surface;

a plurality of spherical beads slidably captured within said channel such that the beads are slidably movable around the circumference of the ring; and a gate assembly mounted to the ring; said gate assembly including a body portion having a bottom wall which straddles the channel, said bottom wall cooperating with said channel to form a passage through which said spherical beads slidably pass, said gate assembly having an entrance side and an exit side, said gate assembly further including a resilient spring arm mounted on the bottom wall of the body portion, said spring arm extending downwardly from the bottom wall into said channel to selectively restrict passage of said beads from said entrance side of said gate assembly to said exit side, said device being operative for counting whereby the wearer manually urges a first bead positioned adjacent to said entrance side from said entrance side past the resilient spring arm to the exit side.

2. The finger ring counting device of claim 1 wherein said plurality of spherical beads comprises 11 beads, one of said 11 beads including an indicia identifying said bead as a starting bead.

3. The finger ring counting device of claim 2, wherein said indicia comprises color.

4. The finger ring counting device of claim 2, wherein said indicia comprises grooves in the surface of said bead.

5. The finger ring counting device of claim 1 wherein said resilient spring arm includes a first portion extending downwardly and a second portion extending at an angle to said first portion longitudinally in the direction of said channel from said entrance side to said exit side so as to allow passage of said beads in one direction.

6. The finger ring counting device of claim 2 wherein said resilient spring arm includes a first portion extending downwardly and a second portion extending at an angle to said first portion longitudinally in the direction of said channel from said entrance side to said exit side so as to allow passage of said beads in one direction.

7. The finger ring counting device of claim 3 wherein said resilient spring arm includes a first portion extending downwardly and a second portion extending at an angle to said first portion longitudinally in the direction of said channel from said entrance side to said exit side so as to allow passage of said beads in one direction.

8. The finger ring counting device of claim 4 wherein said resilient spring arm includes a first portion extending downwardly and a second portion extending at an angle to said first portion longitudinally in the direction of said channel from said entrance side to said exit side so as to allow passage of said beads in one direction.

9. The finger ring counting device of claim 1 wherein said entrance side of said gate assembly includes an indicia.

10. The finger ring counting device of claim 2 wherein said entrance side of said gate assembly includes an indicia.

11. The finger ring counting device of claim 4 wherein said entrance side of said gate assembly includes an indicia.

12. The finger ring counting device of claim 1 wherein said entrance side of said gate assembly includes an indicia.

13. The finger ring counting device of claim 1 wherein said body portion of said gate assembly further includes a top wall constructed and arranged for receiving an ornamental element thereon.

14. The finger ring counting device of claim 13 wherein said top wall includes a recess for receiving an ornamental insert.

15. The finger ring counting device of claim 5 wherein said body portion of said gate assembly further includes a top wall constructed and arranged for receiving an ornamental element thereon.

16. The finger ring counting device of claim 15 wherein said top wall includes a recess for receiving an ornamental insert.

* * * * *